US006503342B1

(12) United States Patent
Wright et al.

(10) Patent No.: US 6,503,342 B1
(45) Date of Patent: Jan. 7, 2003

(54) PROCESSES FOR THE PRODUCTION OF ZINTL COMPOUNDS, INTERMETALLIC COMPOUNDS AND ELECTRONIC COMPONENTS INCLUDING INTERMETALLIC COMPOUNDS

(76) Inventors: Dominic Wright, University of Cambridge Department of Chemistry, Lensfield Road, Cambridge CB2 1EW (GB); Alex Hopkins, University of Cambridge Department of Chemistry, Lensfield Rd., Cambridge CB2 1EW (GB); Neil Stoodley, Electron Tubes Limited, Bury Street, Ruislip, Middlesex HA4 7TA (GB)

( * ) Notice: Subject to any disclaimer, the term of this patent is extended or adjusted under 35 U.S.C. 154(b) by 0 days.

(21) Appl. No.: 09/647,768

(22) PCT Filed: Apr. 8, 1999

(86) PCT No.: PCT/GB99/01078

§ 371 (c)(1),
(2), (4) Date: Dec. 22, 2000

(87) PCT Pub. No.: WO99/53111

PCT Pub. Date: Oct. 21, 1999

(30) Foreign Application Priority Data

Apr. 15, 1998 (GB) ..... 9808003

(51) Int. Cl.[7] ..... C23C 22/00

(52) U.S. Cl. ..... 148/250; 148/253; 148/261; 427/226

(58) Field of Search ..... 148/240, 250, 148/253, 261; 427/226

(56) References Cited

U.S. PATENT DOCUMENTS 3,438,805 A * 4/1969 Potrafke ..... 106/1.05
4,617,204 A 10/1986 Haushalter ..... 427/304
5,368,701 A 11/1994 Warren et al. ..... 204/59 QM
5,705,695 A 1/1998 Haushalter et al. ..... 564/281

OTHER PUBLICATIONS

Beswick, M.A. et al., "Stoichiometric assembly of $[Sb(PCy)_3]_2Li_6$ $6HNMe_2$ $2C_6H_5Me$; a highly fluxional antimony(III) phosphinidine complex containing $Me_2NH$ ligation of lithium," *Chem. Commun.*, 1879–1880, Royal Society of Chemistry (1997) (no month data).

Beswick, M.A. et al., "Low–Temperature Synthesis of Zintl Compounds with a Single–Source Molecular Precursor," *Science* 281:1500–1501, American Association for the Advancement of Science (Sep. 1998) (no month data).

(List continued on next page.)

*Primary Examiner*—John Sheehan
*Assistant Examiner*—Andrew L. Oltmans
(74) *Attorney, Agent, or Firm*—Sterne, Kessler, Goldstein & Fox P.L.L.C.

(57) ABSTRACT

Disclosed is a process for the production of Zintl compounds by thermal decomposition of heterometallic phosphinidene complexes. The heterometallic phosphinidene complex typically comprises at least two metals, at least one of which is selected from a Group I metal, $M^1$, and another being a metal $M^2$, selected from Group 13, 14 or 15 of the Periodic Table. The heterometallic phosphinidene complex further comprises one or more phosphinidene ligands, [PR], wherein R is typically a substituted or unsubstituted hydrocarbyl group, and a Lewis base stabilizing ligand. Thermal decomposition of the heterometallic phosphinidene complexes in accordance with the invention forms a Zintl compound comprising metals $M^1$ and $M^2$ coordinated to Lewis base stabilizing ligands, Lg. The invention further provides a process for removal of the stabilizing ligand from the Zintl compounds to form an intermetallic compound. Intermetallic compounds having photoactive characteristics may be formed by this process, and are useful in the production of photoactive layers in electronic devices.

60 Claims, 8 Drawing Sheets

OTHER PUBLICATIONS

*Chemistry, Structure and Bonding of Zintl Phases and Ions*, Kauzlarich, S.M., ed., 306 pp., VCH Publishers, Inc., New York, NY (1996) (no month data).

Corbett, J.D., "Polyatomic Zintl Anions of the Post–Transition Elements," *Chem. Rev.* 85:383–397, American Chemical Society (1985) (no month data).

Paver, M.A. et al., "Structure and Bonding in Organometallic Anions of Heavy Group 14 and 15 Elements," *Angew. Chem. Int. Ed. Engl.* 34:1545–1554, VCH Verlagsgesellschaft mbH (1995) (no month data).

International Search Report for International Application No. PCT/GB99/01078, mailed Jun. 9, 1999.

* cited by examiner

PROCESSES FOR THE PRODUCTION OF ZINTL COMPOUNDS, INTERMETALLIC COMPOUNDS AND ELECTRONIC COMPONENTS INCLUDING INTERMETALLIC COMPOUNDS

FIELD OF THE INVENTION

This invention relates to processes for the production of Zintl compounds, processes for the production of intermetallic compounds and processes for manufacturing electronic components including intermetallic compounds. In particular, this invention relates to the application of intermetallic compounds in the manufacture of electronic components. More specifically, this invention relates to a method of applying intermetallic compositions onto the surface of electronic components.

BACKGROUND OF THE INVENTION

Intermetallic compounds and Zintl phases have been known for some time. Zintl compounds are binary compounds formed between alkali or alkaline earth elements and post transition elements [(see for example, "Chemistry, Structure, and Bonding of Zintl Phases and Ions", Ed. Susan M. Kauzlarich, VCH Publishers, (1996)]. One of the earliest examples of Zintl ions were those formed by the reaction of sodium in liquid ammonia with a variety of Group 14 metals, such as lead, to form, e.g. $4[Na(NH_3)_n^+][Pb_9]^{4-}$. These complexes are unstable due to the facile liberation of $NH_3$, which can occur at low temperatures to form intermetallic compositions of the type $NaPb_x$.

The isolation of solid derivatives of Zintl anions using ethylenediamine in the place of ammonia has been reported in which the alloy composition $NaSn_{2.4.2.5}$, on slow dissolution in warm ethylenediamine followed by precipitation on the addition of THF or monoglyme, generates the species $Na_4(en)_7Sn_9$ (en=ethylenediamine).

Macrocyclic ligands, such as 2,2,2-crypt, have been used in place of ammonia or ethylenediamine due to their effective sequestering capabilities. The stability of these cryptate complexes, an example of which includes $[2(2,2,2\text{-crypt-K})^+[Pb_5]^{2+}$, have enabled extensive characterisation of their crystal structures.

However, hitherto, the available techniques for producing Zintl compounds, have been cumbersome, especially where it is desired to produce Zintl compounds with predetermined stoichiometries. For example, the majority of these compounds have been obtained by dissolving pre-formed stoichiometric alloys of metals in ammonia. This route, which is required to obtain stoichiometric control of the product, involves high-temperature methods and highly specialised techniques. As a result, Zintl compounds, particularly of the heaviest (most metallic) post-transition elements, have generally only been prepared in very small scale (10–50 mg) and have therefore not been broadly accessible to the majority of synthetic chemists or useful in industrial processes.

SUMMARY OF THE INVENTION

As indicated, the invention also relates to processes for producing intermetallic compounds. Intermetallic compounds, which may be defined as mixed metal compounds of the type $M^1_xM^2_y \ldots M^3_z$, possess properties that do not necessarily resemble the respective alloys and often exhibit properties which are intermediate between their component elements.

The majority of intermetallic alloys behave as semiconductors and have thus found extensive applications in the electronics industry. Some intermetallic compounds display photoactive properties and these have been employed in photodetector components. The properties of the intermetallic layer are dependent upon the stoichiometry of the metal components. Thus the stoichiometric control of the metal components is important in order to achieve the desired electrical properties of the intermetallic layers.

The existing process for the manufacture of electronic components such as vacuum photodiodes having intermetallic layers based on antimony and alkali metals, involve the high temperature formation of antimony/alkali metal intermetallic layers using metal vapours. This deposition process typically involves predepositing an antimony layer onto the surface of the electronic component, followed by the addition of an alkali metal in vapour form. This process is highly labour intensive and the characteristics of the intermetallic films deposited are often variable as a consequence of inherently poor control of their stoichiometry.

It would therefore be highly desirable to improve the method in which intermetallic layers can be deposited onto electronic components during their manufacture. In addition, it would be advantageous to obtain a higher degree of stoichiometric control than those offered by the existing vapour deposition method.

Thus, it is a further object of the present invention to provide an improved process of forming intermetallic layers for use in the manufacture of electronic components. Such electronic components include photomultipliers and other photodetectors used in, e.g., medical scanners and scientific instruments.

Another object of the present,invention is to provide a method of producing intermetallic layers in which the stoichiometry can be controlled to furnish films with essentially consistent characteristics.

The present invention in all its aspects followed from the development of a novel procedure for producing Zintl compounds from stable precursors. This procedure enabled for the first time the production of Zintl compounds by a convenient route in a manner which permitted the Zintl compounds to be produced with preselected stoichiometries between the metal components thereof.

Advantageously, the use of a stable precursor to generate a Zintl compound that may be subsequently converted to an intermetallic alloy according to the present invention, allows the possibility for the deposition of the intermetallic alloy from solution at low temperature. Such a method provides a substantial improvement over existing vapour phase deposition techniques. The method of the present invention provides a convenient route to the formation of Zintl compounds on a gram or multi-gram scale.

Thus, the invention provides a novel application of Zintl compounds, especially when produced in accordance with the first aspect of the invention, in the manufacture of electronic components having surface coatings formed from intermetallic compounds.

DESCRIPTION OF THE PREFERRED EMBODIMENTS

According to the present invention, there is provided a process for the production of a Zintl compound comprising subjecting a heterometallic phosphinidene complex to thermal decomposition.

The heterometallic phosphinidene complex typically comprises at least two metals. Preferably one of the metals may be a metal of Group 13, 14 or 15 of the Periodic Table. Particularly preferred metals are those from Group 15 of the Periodic Table, including As, Sb and Bi.

The second of the metals is preferably a metal of Group 1 of the Periodic Table, e,g, Li, Na, K, Rb or Cs.

The heterometallic phosphinidene complex used in the process of the invention preferably contains one or more phosphinidene ligands [PR], which may be the same or different. The phosphorus atom of each phosphinidene ligand is covalently linked to a substituted or unsubstituted hydrocarbyl group, R.

The unsubstituted or substituted hydrocarbyl group, R, typically contains 1 to 15, preferably 4 to 10 carbon atoms, and may be selected from alkyl, alkenyl, alkynyl, cycloalkyl, aryl, aralkyl, and alkaryl. Typical substituents include F and alkylsilyl groups.

A particularly preferred phosphinidene ligand is PCy (Cy=cyclohexyl, $C_6H_{11}$), wherein the phosphorus atom is linked to a cyclohexyl group. Other examples of possible substituents include $^t$Bu [tertiary butyl, $(CH_3)_3C$—], $^i$Pr [isopropyl, $(CH_3)_2CH$—], bis(trimethylsilyl)methyl [$(CH_3Si)_2CH$—], tris(trimethylsilyl)methyl {[$(CH_3)_3Si]_3C$—}, trimethylsilyl [$(CH_3)_3Si$] and fluorinated groups such as pentafluorophenyl ($C_6F_5$).

The phosphorus atom of each phosphinidene ligand in the heterometallic phosphinidene complex is generally coordinated to four metal atoms. It is preferred that the phosphorus atom is coordinated to three Group I metal atoms and one metal atom of Groups 13, 14 or 15.

The heterometallic phosphinidene complex may further comprise an additional ligand or ligands which may be Lewis bases. The structure of the complex will depend upon the identities of the metals and ligands.

Thus the preferred phosphinidene complexes referred to above can have various structures depending on the Group 13, 14 or 15 metal(s) present and on the alkali metal(s) and Lewis base ligand(s). Generally, however, the phosphinidene ligands (PR) are bridged between the Group 13, 14 or 15 metals and the alkali metals (i.e. the complexes will contain $M^1$—P(R)—$M^2$ groupings; $M^1$=Group 13–15 metal, $M^2$=Group 1 metal) and the phosphorus atom of the phosphinidene group will generally be coordinated by up to four metal atoms (for example, one Group 13, 14 or 15 metal and three alkali metals, as in Compound I).

The Group 13, 14 and 15 metals will usually be in their +3, +2 and +3 oxidation states respectively.

As indicated, the heterometallic phosphinidene complex may further comprise an additional, Lewis base ligand coordinated to one or more of the metal atoms. Preferred Lewis base ligands are primary, secondary or tertiary amines of formula $R^1R^2R^3N$, wherein each of $R^1$, $R^2$ and $R^3$ represent hydrogen, a $C_1$–$C_{10}$ alkyl or $C_6$–$C_{10}$ aryl group. In addition other Lewis bases such as polyamines [e.g. ethylenediamine $(H_2NCH_2)_2$], permethylated polyamines (for example TMEDA {$[(CH_3)_2NCH_2]_2$} and PMDETA {$[(CH_3)_2NCH_2CH_2]_2NCH_3$}), pyridine ($C_5H_5N$) or polypyridines [such as 2,2'-bipyridine $(C_5H_4N)_2$], may be employed. Oxygen donors such as ethers (e.g. tetrahydrofuran, THF) may also be used.

The thermal decomposition process of the invention may result in the co-production of a phosphorus compound having at least one P—P bond, e.g. a cyclic phosphinidene. The thermal decomposition typically involves a so-called "reductive phosphinidene coupling" or "reductive elimination" in the conversion of the phosphinidene intermediate into the Zintl complex. In such instances, the formation of phosphorus-phosphorus bonds, which have the highest bond energy between any Group 15 elements, provides the necessary thermodynamic driving force for the reaction to take place. As indicated below, a cyclic phosphinidene compound may be formed as a by-product and as will be appreciated, such a by-product will contain more than one P—P bond.

Thus in one embodiment, the present invention comprises subjecting a heterometallic phosphinidene complex to a thermal decomposition reaction, wherein the heterometallic phosphinidene comprises:

(i) a plurality of phosphinidene ligands, [PR] wherein each R which may be the same or different, is selected from substituted or unsubstituted $C_1$–$C_{15}$ alkyl, alkenyl, alkynyl, cycloalkyl, aryl, aralkyl, and alkaryl, wherein the substituents may be F or alkylsilyl groups, (ii) at least one metal selected from a Group 13, 14 or 15 metal;

(iii) at least one Group I metal selected from Li, Na, K, Rb, Cs; and (iv) a plurality of labile, Lewis-base stabilising ligands, each of which may be the same or different, (and preferably as described above)

and said thermal decomposition process results in the co-production of a cyclic phosphinidene compound $[PR]_n$, wherein n=4–6.

A particularly preferred process according to the invention comprises subjecting a heterometallic phosphinidene complex to a thermal decomposition reaction, wherein the heterometallic phosphinidene complex comprises:

(i) a plurality of phosphinidene ligands, [PR] wherein each R which may be the same or different,-is selected from substituted or unsubstituted $C_1$–$C_{15}$ alkyl, alkenyl, alkynyl, cycloalkyl, aryl, aralkyl, and alkaryl, wherein the substituents may be F or alkylsilyl groups, (ii) at least one metal selected from Ge, Sn, Pb, As, Sb and Bi.

(iii) at least one metal selected from Li, Na, K, Rb and Cs, (iv) a plurality of labile, Lewis-base stabilising ligands, each of which may be the same or different, and said thermal decomposition process results in the co-production of a cyclic phosphinidene compound [PR], wherein n=4–6.

In the above embodiments R preferably contains 4 to 10 carbon atoms.

Preferably the phosphinidene compound has the formula $(M^1)_n(M^2)_m(Lg)_p(PR)_r$, wherein $M^1$ is a metal of Group 13, 14 or 15 of the Periodic Table, $M^2$ is a metal of Group 1 of the Periodic Table, PR is a phosphinidene ligand, Lg is a Lewis base ligand and each of n, m, p and r are in the range 1 to 10.

In the above formula, $M^1$ is preferably As, Sb and Bi and $M^2$ is preferably Li, Na, K or Rb. The group "R" in the phosphinidene ligand (PR) is preferably as defined above. Also, in the above formula, Lg is a Lewis base ligand which may be a primary, secondary or tertiary amine of formula $R^1R^2R^3N$, wherein each of $R^1$, $R^2$ and $R^3$ represent hydrogen, $C_1$–$C_{10}$ alkyl or $C_6$–$C_{10}$ aryl group. In addition other Lewis bases such as polyamines [e.g. ethylenediamine $(H_2NCH_2)_2$], permethylated polyamines (for example TMEDA {$[(CH_3)_2NCH_2]_2$} and PMDETA {$[(CH_3)_2NCH_2CH_2]_2NCH_3$}), pyridines ($C_5H_5N$) or polypyridines (such as 2,2'-bipyridine, $(C_5H_4N)_2$ may be employed. Oxygen donors such as ethers (e.g. tetrahydrofuran, THF) may also be used.

In exemplary phosphinidene compounds, the ratios of m:n may vary from 4:1 to 1:4. Typically, m and n are 1, 2, 3 or 4, thus in phosphinidene compounds which are especially useful as starting materials, m may be 1 and n may be 3. In other phosphinidene compounds of interest, m is 1 and n is 2, or m and n are both 1. The integers p and r are typically in the range 4 to 8 and in exemplary compounds, both p and r are 6.

Especially preferred heterometallic phosphinidene compounds suitable for use in the process of the invention may be represented by the formula $[Sb(PCy)_3]_2Li_6.6Me_2NH.2C_6H_5CH_3$ (I), $\{[cyclo\text{-}(CyP)_4Sb]Na.Me_2NH.TMEDA\}_2$ (IV) and $\{[cyclo\text{-}(^tBuP)_3As]Li.TMEDA.THF\}$ (VI).

It is preferred that the thermal decomposition process is carried out at a temperature of greater than 20° C., and preferably at a temperature range of between 25–100° C. The decomposition is preferably carried out with the phosphinidene compound in solution in an organic solvent such as a hydrocarbon (e.g. an n-alkane, such as n-hexane), an aromatic hydrocarbon (e.g. toluene) or tetrahydrofuran (THF).

Where the heterometallic phosphinidene complexes of the invention either contain stabilising Lewis base ligands, or stabilising Lewis base ligands which are aprotic (e.g. TMEDA, PMDETA, pyridines, polypyridines and oxygen donors such as ethers), the decomposition process may require activation. The activation procedure typically comprises subjecting the heterometallic phosphinidene complex to thermal decomposition as described above, in the presence of a primary or secondary amine (e.g. $Me_2NH$) added separately to the complex.

In preferred embodiments of the invention, the thermal decomposition process results in the formation of a Zintl compound comprising a polymetallic anion consisting of atoms of one or more metals. In many instances, the polymetallic anion is coordinated with metal cations, and the metal cations are coordinated with Lewis base ligands. The Zintl compounds formed typically comprise a polymetallic anion consisting of atoms of a metal $M^1$, wherein said polymetallic anion may or may not be coordinated with cations of a metal $M^2$, and the cations of a metal $M^2$ are coordinated with Lewis base ligands Lg. In other examples of Zintl compounds, the cation may be separated from the polymetallic anion. Thus as described in "Polyatomic Zintl Anions of the Post-Transition Elements", Corbett, J. D., *Chem. Rev.,* 1985, 85, 385–397, a wide variety of different structures is possible. Thus where the ligand:alkali metal cation ratio is high, or when polyether or cryptand ligands are present, the cations may be "separated" by their coordination to the Lewis base ligands, so the cation is separated from the polymetallic anion.

Preferably the Zintl compound has the formula $(M^1)_{n'}(M^2)_{m'}(Lg)_{p'}$, wherein $M^1$, $M^2$ and Lg are as defined above and each of n', m' and p' are in the range 1 to 10. $M^1$ is preferably a metal of Group 13, 14 or 15 of the Periodic Table. Especially preferred metals are those in Group 15, in particular As, Sb and Bi. $M^2$ may be a metal of Group 1 of the Periodic Table, preferably Li, Na, K or Rb. Lg is preferably a Lewis base ligand which may be a primary, secondary or tertiary amine of formula $R^1R^2R^3N$, wherein each of $R^1$, $R^2$ and $R^3$ represent hydrogen, $C_1$–$C_{10}$ alkyl or $C_6$–$C_{10}$ aryl group. In addition other Lewis bases such as polyamines [e.g. ethylenediamine $(H_2NCH_2)_2$], permethylated polyamines (for example TMEDA $\{[(CH_3)_2NCH_2]_2\}$ and PMDETA $\{[(CH_3)_2NCH_2CH_2]_2NCH_3\}$, pyridine $(C_5H_5N)$ or polypyridines (such as 2,2'-bipyridine, $(C_5H_4N)_2$ may be employed. Oxygen donors such as ethers (e.g. tetrahydrofuran, THF) may also be used.

In exemplary Zintl compounds, the ratios of m':n' may vary from 5:1 to 1:5. Typically, m' and n' are 4–9, thus in the Zintl compound of formula (II) n' is 7 and m' is 3. The integer p' depends on the metal $M^2$ and the number of donor atoms in Lg and may be 1–8. The precise stoichiometry of the Zintl compound will depend on the nature and identity of the phosphinidene compound used as starting material (or where more than one phosphinidene compound is used, also on the ratio of different phosphinidene compounds used) and also on the identity of the Lewis acid base. Thus, by varying these parameters, a range of different Zintl compounds may be produced.

In accordance with a second aspect of the invention there is provided the use of a stable heterometallic phosphinidene complex as described above as a precursor for the deposition of a film containing an intermetallic compound.

In accordance with a third aspect the invention there is provided a process for the production of an intermetallic compound comprising:

(a) forming a Zintl compound by a method described above, the Zintl compound comprising a polymetallic anion consisting of atoms of a metal $M^1$, and cations of a metal $M^2$ which are coordinated with stabilising ligands Lg, and (b) subsequently removing the stabilising ligands.

It is preferred that the stabilising ligand is a Lewis base, for example, one of the preferred Lewis bases referred to above. Advantageously, the stabilising ligands may be removed under reduced pressure or by evaporation at atmospheric pressure.

According to the invention, a preferred process for the production of an intermetallic alloy comprises:

(a) forming a Zintl compound by subjecting a heterometallic phosphinidene complex as described above to thermal decomposition, said Zintl compound comprising a polymetallic anion consisting of atoms of a metal $M^1$, and cations of a metal $M^2$ which are coordinated with stabilising ligands Lg, and (b) subsequently removing the stabilising ligands.

A further embodiment of the invention provides a method for forming an intermetallic layer on a surface or surface portion of an electronic device, which method comprises:

(a) applying a Zintl compound to the surface, said Zintl compound comprising a polymetallic anion consisting of atoms of a metal $M^1$, and cations of a metal $M^2$ which are coordinated with stabilising ligands Lg, and (b) subsequently removing the stabilising ligands.

Another embodiment of the invention provides a method for forming an intermetallic layer on a surface or surface portion of an electronic device, which method comprises:

(a) applying a heterometallic phosphinidene compound to the surface, said heterometallic phosphinidene compound being as defined above in connection with the general and preferred aspects of the invention, (b) subjecting the heterometallic phosphinidene compound to thermal decomposition with concomitant loss of stabilising ligands.

It will be appreciated that in the above-mentioned thermal decomposition, there will normally initially be formed a Zintl compound, said Zintl compound comprising a polymetallic anion consisting of atoms of a metal $M^1$ and cation of a metal $M^2$ which are coordinated with stabilising ligands, and that the stabilising ligands will subsequently be lost.

The formation of the Zintl compound and the subsequent loss therefrom of the stabilising ligands may be a single or a two step process. Where the formation of the Zintl compound and removal of the stabilising ligand occurs in two steps, this embodiment of the invention may be defined in terms of a method for forming an intermetallic layer on a surface or surface portion of an electronic device, which method comprises:

(a) applying a heterometallic phosphinidene compound to the surface, said heterometallic phosphinidene compound being defined above in connection with the general and preferred aspects of the invention, (b) subjecting the heterometallic phosphinidene compound to thermal decomposition to a Zintl compound, said Zintl compound comprising a polymetallic anion consisting of atoms of a metal $M^1$ and cation of a metal $M^2$ which are coordinated with stabilising ligands, and (c) subsequently removing the stabilising ligands.

A still further embodiment of the invention provides a method of manufacturing an electronic device having an intermetallic layer on a surface portion thereof, which comprises:

(a) applying a Zintl compound to the surface, said Zintl compound comprising a polymetallic anion consisting of atoms of a metal $M^1$ and cation of a metal $M^2$ which are coordinated with stabilising ligands Lg, and (b) subsequently removing the stabilising ligands.

In the above described methods for forming an intermetallic layer on a surface or a surface portion of an electronic device, the application of a Zintl compound or a heterometallic phosphinidene compound to such a surface, is preferably carried out by a technique such as spin coating, dip coating, vacuum evaporation or electrospray.

In these embodiments, the precise manner in which the polymetallic anion and the metal $M^2$ are arranged will depend on the identities of $M^1$ and $M^2$ and the identities of the ligand(s). In many instances, the polymetallic anion will be coordinated with cations of metal $M^2$.

As it will be appreciated, the ratio of metals in the heterometallic phosphinidene compound can be varied depending upon the ratio of starting materials and conditions in which they are synthesised. The thermal decomposition process of the invention will therefore produce a Zintl compound whose ratio of $M^1$ and $M^2$ (if not necessarily the same as that present in the phosphinidene compound) will be dictated by the individual chemical pathway of the decomposition.

Subsequent removal of the Lewis base stabilising ligands from the Zintl compound will produce an intermetallic compound having a metal composition which is therefore dictated by that of the heterometallic phosphinidene compound. Thus an important feature of the process of the invention is the possibility of selecting a heterometallic phosphinidene compound to produce an intermetallic compound having the desired metal: stoichiometry. As discussed above, the photoactive properties of intermetallic compounds are determined by the stoichiometries of the metal components.

The nature and composition of the intermetallic layer may be adapted to confer desired electrical properties depending upon the electronic device for which it is to be applied to. By using different phosphinidene precursors or Zintl compounds or mixtures thereof, intermetallic layers with different proportions of metals may be formed. Intermetallic layers, in particular, those comprising an alkali metal and one or more metals selected from those of Group 13, Group 14 or Group 15 of the Periodic Table (especially in stoichiometric quantities) are particularly useful in such applications, as they possess highly desirable photoactive characteristics. Particularly useful is the application of intermetallic layers having electron emitter properties, such as those required by photoelectric devices. For example, intermetallic alkali metal antimonide films have wide applications as batteries and photoactive materials in photomultipliers which are used e.g. (1) medical scanners, (2) scientific instruments, and (3) particle physics.

Structural formulae of exemplary compounds are given in the accompanying drawings (FIGS. 1–6).

Figure 1:
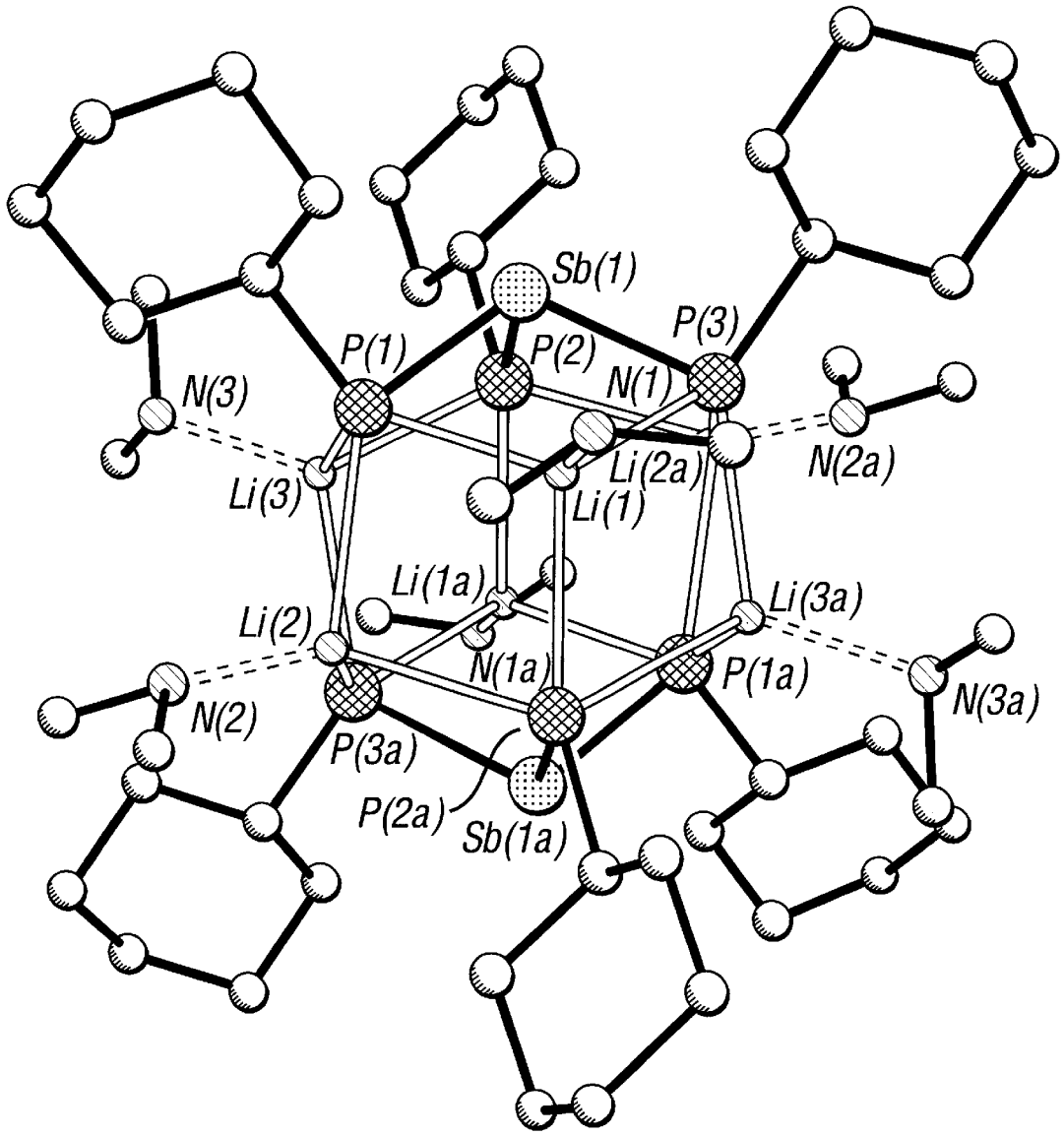
FIG. 1 Structure of heterometallic phosphinidene compound $[Sb(PCy)_3]_2Li_6.6HNMe$ (I).
Figure 2:
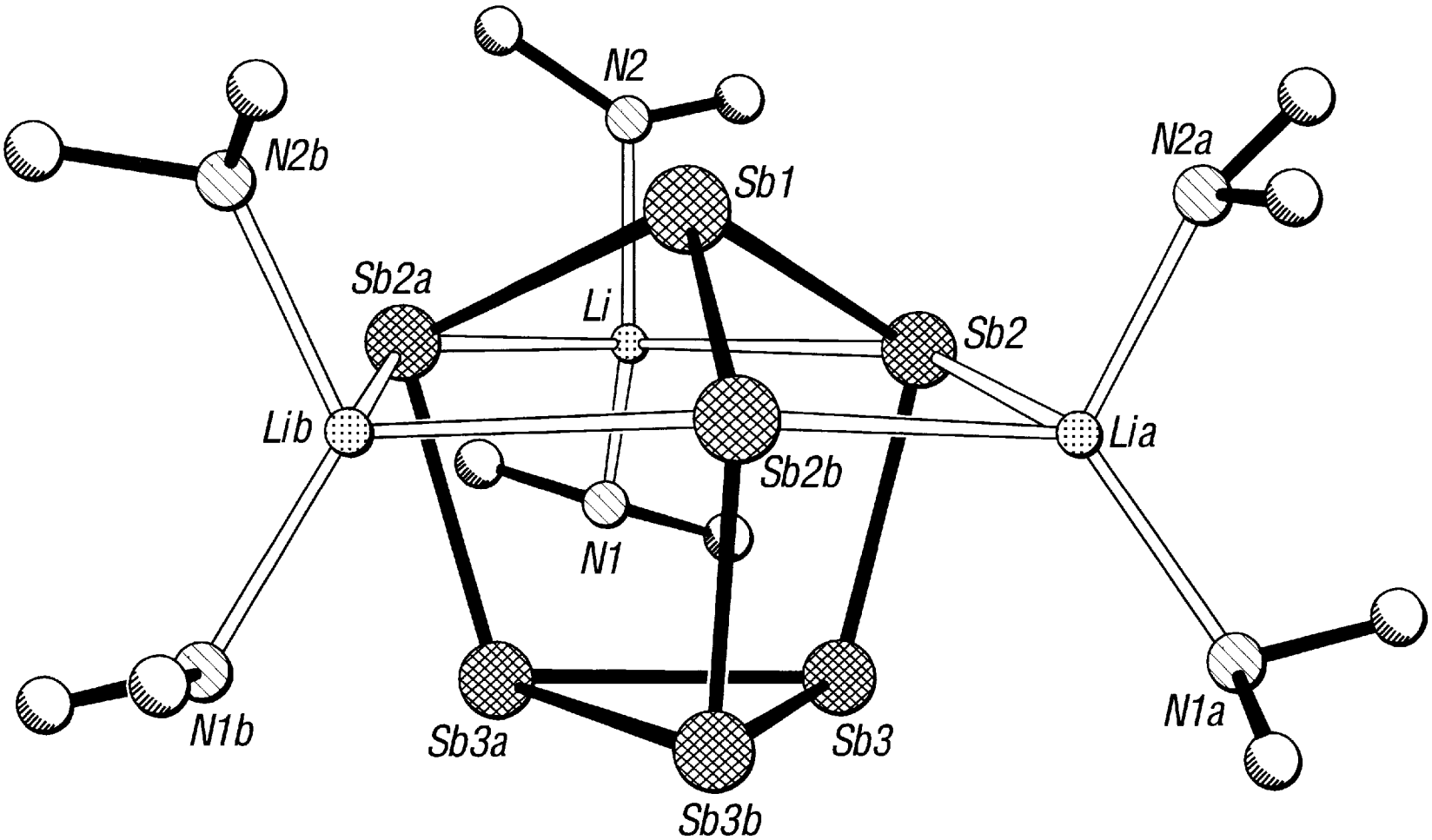
FIG. 2 Structure of Zintl compound $[Sb_7Li_3.6HNMe_2]$ (II).
Figure 3:
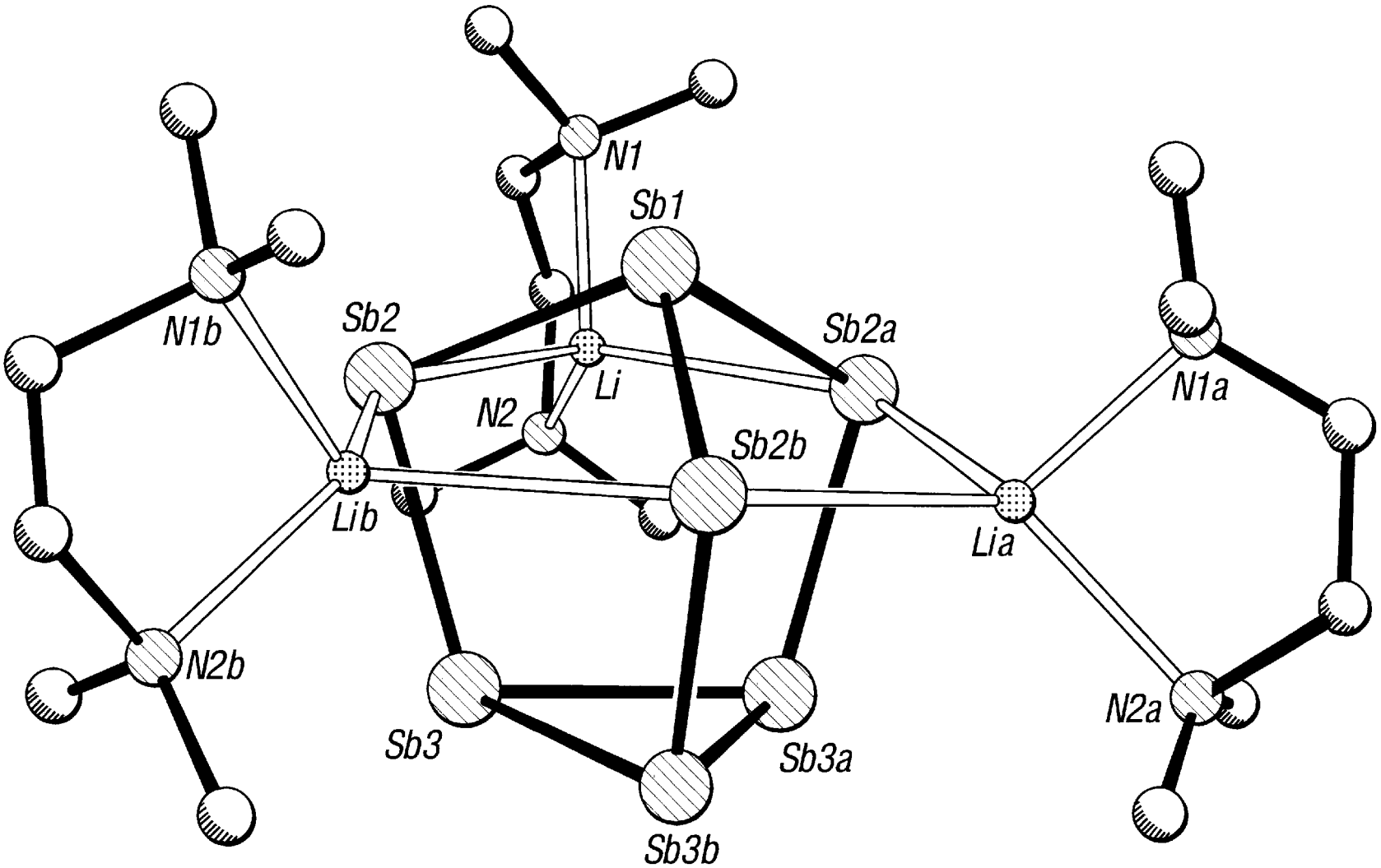
FIG. 3 Structure of Zintl compound $\{[(TMFDA)Li]_3Sb_7\}$ (III).
Figure 4:
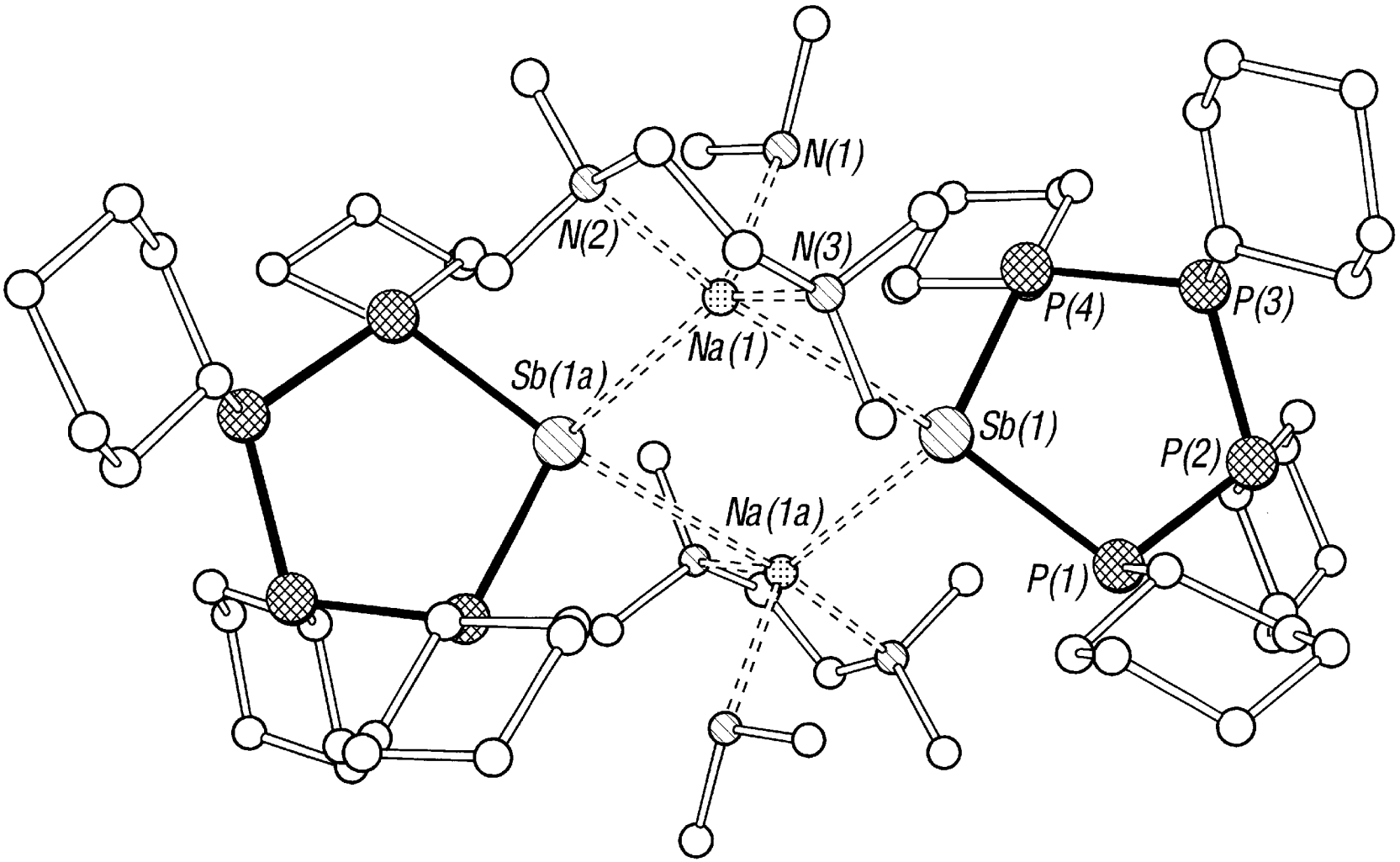
FIG. 4 Structure of $\{[CyP]_4SbNa.TMEDA.Me_2NH)_2$ (IV).
Figure 5:
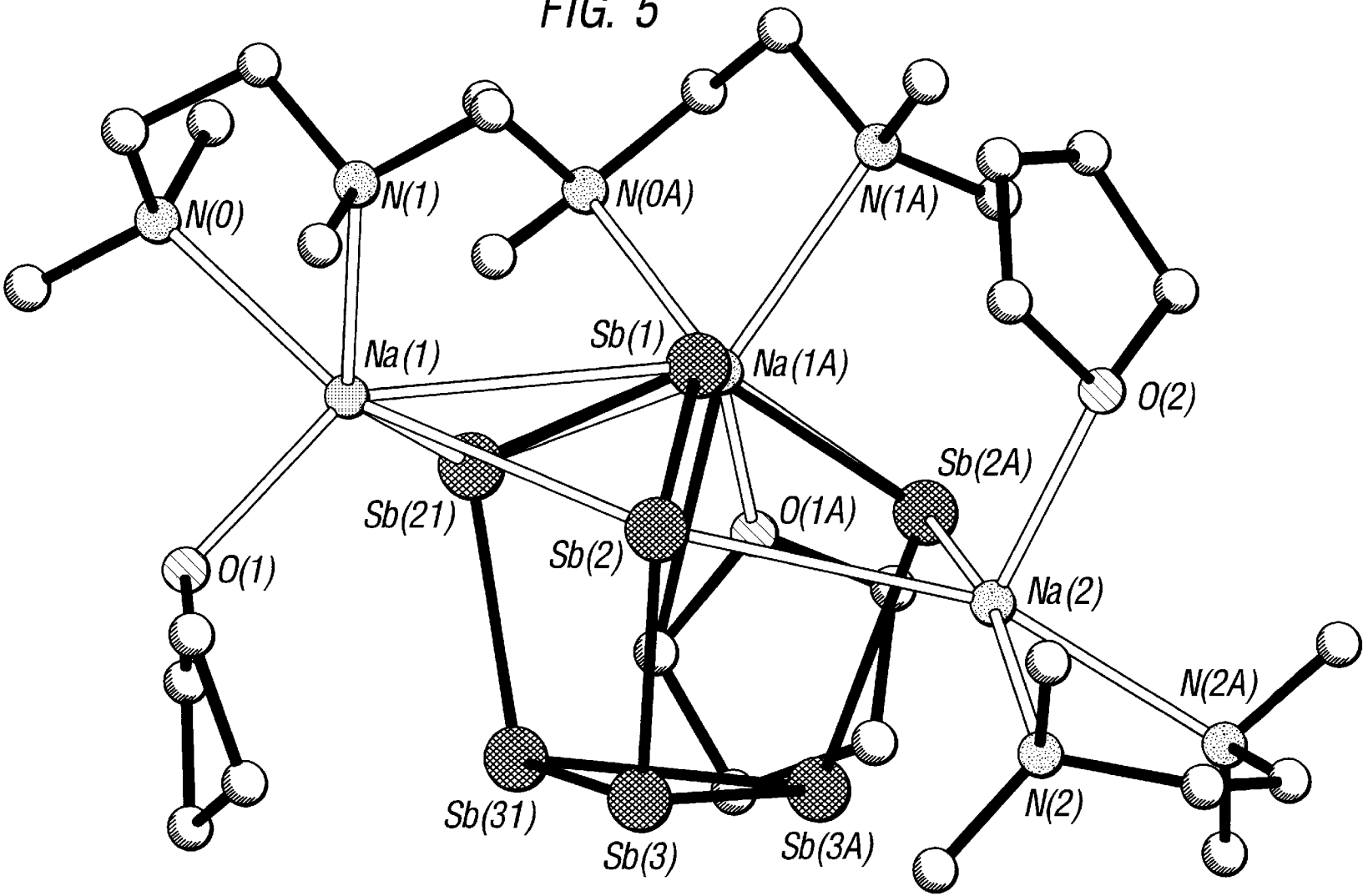
FIG. 5 Structure of $[Sb_7Na_3.3TMEDA.3THF]$ (V).
Figure 6:
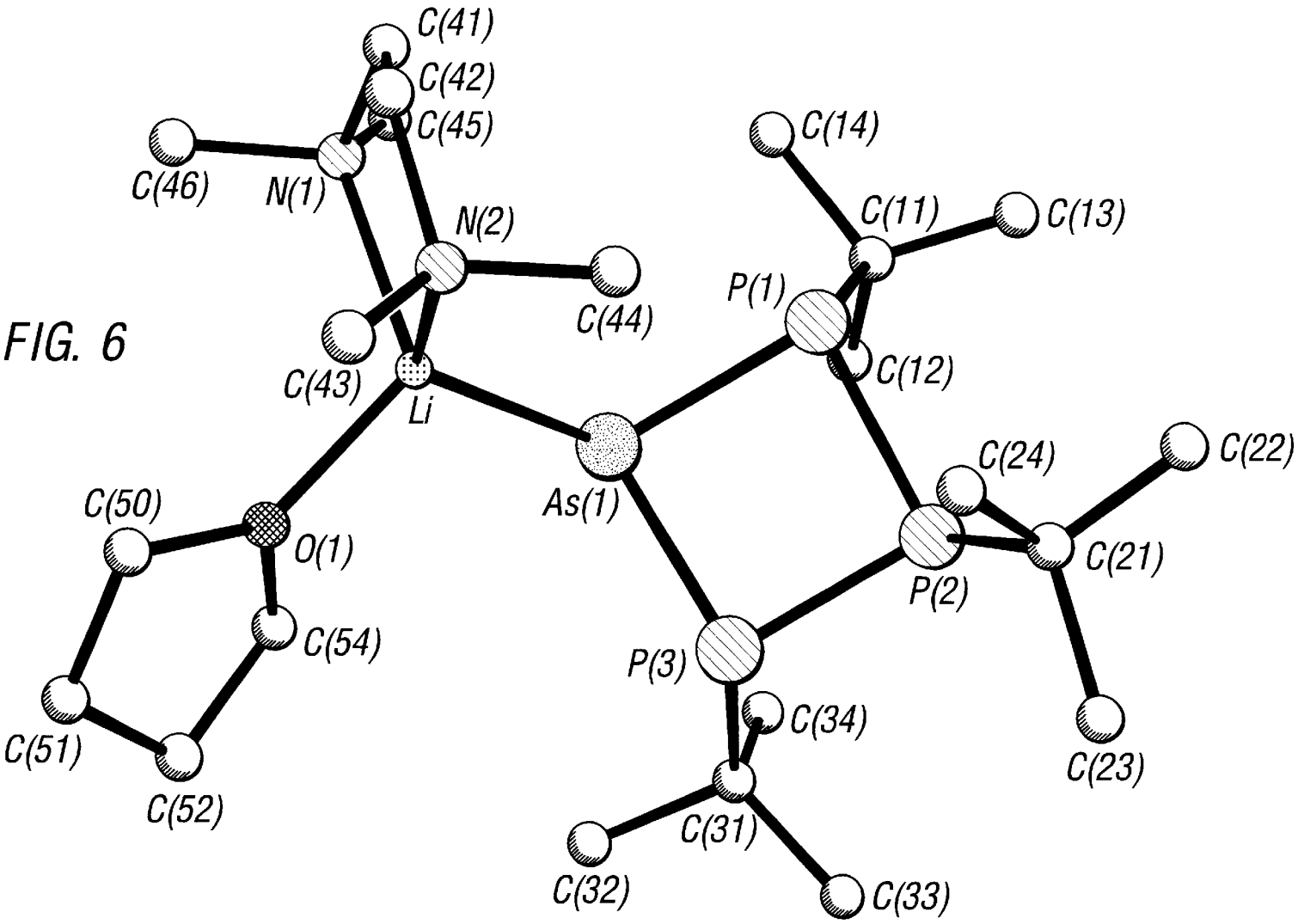
FIG. 6 Structure of heterometallic phosphinidene compound {cYclo-$[(^tBuP)_3As]$Li.TMEDA.THF) (VI).

The production of Zintl compounds in accordance with the invention and their conversion to intermetallic compounds is described in the following Examples.

EXAMPLES

1. Synthesis of $[Sb(PC_y)_3]_2Li_6.6HNMe_2.2C_6H_5CH_3$ (I)

To a stirred and chilled suspension of $[LiPHCy]_n$ (7.53 mmol of monomer) in toluene (5 ml) was added to a solution of $[Sb(NMe_2)_3]$ (2.51 mmol, 1.36 $cm^3$, 1.84 mol $dm^{-3}$ in toluene).

The suspension was stirred and gradually allowed to warm towards 0° C. at which stage a yellow precipitate was observed. This was dissolved by the addition of chilled toluene (8 $cm^3$) and THF (1 $cm^3$). The red solution produced was stored at −35° C. for 48 hr over which period crystals suitable for X-ray diffraction studies grew.

The following data refer to this material: yield 1.02 g (57%); decomp. 170° C.; IR (Nujol), major bands at 1257 (m), 1178(s), 1051(s), 992.5(m), 897(s), 846(s), 730(m), 694(w); $^1H$ NMR (400.16 MHz, +25° C., $C_6D_5CD_3$), δ=7.0 (5H, mult., aryl C—H, $C_6H_5CH_3$), 3.94 (13H, s., Me, $Me_2NH$), 2.5–1.2 (33H, overlapping mult., Cy and $C_6H_5CH_3$ Me group (2.10)); $^7Li$ NMR (155.513 MHz, +25° C., $C_6D_5CD_3$), δ=5.57 (binomial sept., $^1J^{31}_{P-^7Li}$=14 Hz) (rel. to $LiCl/D_2O$) (7.14 rel. to $PhLi/C_6D_5CD_3$); $^{31}P$ NMR (162.000 MHz, +25° C., $C_6D_5CD_3$), δ=−263.5 (rel. to neat $(MeO)_3P$; br. s., width at half height 1130 Hz); Elemental analysis calc. C, 52.3; H, 8.7; N, 5.6; found C, 52.0; H, 8.4; N 4.4.

Crystal data for I; $C_{31}H_{62}Li_3N_3P_3Sb$, M=712.32, space group monoclinic $P2_1/c$, α=13.460(3), β=18.123(3), γ=16.589(4)Å, b=99.83(2)°, V=3987(2)$Å^3$, Z=4, $\rho_{calc}$= 1.187 $Mgm^{-3}$, T=150(2)K, $\mu$(Mo−Kα)=0.834 $mm^{-1}$, F(000)=1496. Yellow cubes, crystal dimensions 0.30×0.25× 0.20 mm. 3717 reflections (2q<45.0°) were collected on a Siemens R3mV diffractometer using Mo−Kα radiation (λ=0.71073 Å), graphite monochromator and θ/2ω scans (2.57≦θ≦19.99°). 3717 independent reflections ($R_{int}$=

0.021) after a semi-empirical absorption correction was applied. The structure was solved using direct methods and refined by full matrix least squares based on $F^2$(SHELXL93), with all non-hydrogen atoms assigned anisotropic displacement parameters; cyclohexyl, toluene and amine H atoms were fixed in idealised positions and allowed to ride on the relevant C or N atoms. The refinement converged to R1=0.0748 for data F>4σ/(F) and wR2=0.2722 for all data, goodness of fit=1.013, and weighting scheme $w=1/[\sigma_2(F_o^2)+(0.0597P)^2+18.32P]$, where $P=(F_o^2+2F_c^2)/_3$. Largest peak and hole in the final difference map; 0.913, −0.689 eÅ$^{-3}$. Crystals of I were weakly diffracting. Restraints were applied for the lattice-bound toluene which is disordered over two (50:50) sites about a two-fold axis.

If I is subjected to a vacuum (ca. $10^{-3}$ atm, 15 min), almost all the $Me_2NH$ is removed, giving the unsolvated complex {[$Sb(PCy)_3$]$Li_6$} [I*].

2. Thermal Decomposition of [$Sb(PCy)_3$]$_2Li_6$.6$HNMe_2$.2$C_6H_5CH_3$ (I) to [$Sb_7Li_3$.6$HNMe_2$] (II)

A solution of [$Sb(PCy)_3$]$_2Li_6$.6$HNMe_2$ (I) (1.0 g, 1 mmol) in toluene (10 ml) was stirred at 30–40° C. for 10 min, giving a deep red solution and with almost all of the starting material dissolving. Cold filtration (ca. 0° C.) followed by storage of the filtrate at −35° C. (48 hr) gave a large crop of deep red plates of [$Sb_7Li_3$.6$HNMe_2$] (II). Although II is too thermally unstable at 25° C. to be isolated as a pure material, the yield is almost quantitative.

X-ray data for II; $C_{12}H_{42}Li_3N_6Sb_7$, M=1143.58, trigonal, space group P-3, α=11.508(1), γ=14.954(2) Å, Z=1, $\rho_{calc.}$= 2.214 Mgm$^{-3}$, λ=0.71073 Å, T=198(2)K, μ(Mo−Kα)=5.438 mm$^{-1}$, F(000)=1044. Data were collected on a Siemens P4 diffractometer using an oil-coated rapidly-cooled crystal of dimensions 0.10×0.36×0.48 mm by the θ/2ω method (1.36°≦θ≦25.00°). Of a total of 4482 collected reflections, 2004 were independent ($R_{int}$=0.048). The structure was solved by direct methods and refined by full-matrix least-squares on $F^2$ to final values of R1(F>4σ/(F))=0.053 and wR2=0.168 (all data); largest peak and hole in final difference map 2.038 and −1.402 eÅ$^{-3}$.

2A. Thermal decomposition of [$Sb(PCy)_3$]$Li_6$} [I*]to [$Sb_7Li_3$.6$HNMe_2$] (II)

Neat liquid $Me_2NH$ was added to a dilute THF solution of [$Sb(PCy)_3$]$Li_6$} [I*] at a temperature of 25° C. or below. Decomposition of [I*] to Zintl compound (II) occurs immediately.

3. Synthesis of {[(TMEDA)Li]$_3Sb_7$} (III)

Excess TMEDA (ca. 1 ml) was added to a deep red solution of [$Sb_7Li_3$.6$HNMe_2$] (II), prepared as described in Example 2 or Example 2A. Storage at −35° C. (12 hr) produced a large crop of red crystalline plates of {[(TMEDA)Li]$_3Sb_7$} (III). The yield of III is quantitative.

X-ray data for III; $C_{32}H_{64}Li_3N_6Sb_7$, M=1407.97, monoclinic, space group P21/m, α=10.192(1), β=20.944(3), γ=11.967(2) Å, b=92.22(1)°, Z=4, $\rho_{calc.}$=1.829 Mgm$^{-3}$, 'λ=0.71073 Å, T=213(2) K, μ(Mo−Kα)=3.673 mm$^{-1}$, F(000)=1328. Data were collected on a Siemens P4 diffractometer using an oil-coated rapidly-cooled crystal of dimensions 0.20×0.35×0.40 mm by the θ/2ω method (1.94°≦θ≦25.00°). Of a total of 4636 collected reflections, 5803 were independent ($R_{int}$=0.051). The structure was solved by direct methods and refined by full-matrix least-squares on $F^2$ to final values of R1(F>4σ/(F))=0.066 and wR2=0.241 (all data) [$R1=\Sigma|F_o-F_c|/\Sigma F_o$ and $wR2=(\Sigma w(F_o^2-F_c^2)^2/\Sigma\omega(F_o^2)^2)^{0.5}$, $w=1/[\sigma^2(F_o^2)+(yP)^2+xP]$, $P=F_o^2+(2F_c^2/3)$]; largest peak and hole in final difference map 1.772 and −2.419 eÅ$^{-3}$. The —$CH_2$— and Me groups of all the TMEDA ligands are disordered over two 1:1 sites. The disordered toluene molecule is disordered over two sites about a two-fold axis.

The formation of [$CyP_4$] along with II and III was confirmed by determination of the unit cell. The parameters are in agreement with those obtained in the literature (Bart, J. C. J., *Acta. Crystallogr.* Section B, 1969, 25, 762).

4. Formation of Intermetallic Phase from [$Sb_7Li_3$.6$HNMe_2$] (II) or {[(TMEDA)Li]$_3Sb_7$} (III)

Storage of the Zintl compounds [$Sb_7Li_3$.6$HNMe_2$] (II) or {[TMEDA]Li]$_3Sb_7$}(III) at room temperature over a period of time leads to a slow loss of amine ligand to form a lustrous intermetallic phase, comprising LiSb and Sb. When either complex is stored under vacuum, the loss of amine ligand occurs more rapidly (ca. 15 min, at $10^{-3}$ atm.).

5. Synthesis of {[cyclo-$(CyP)_4Sb$]Na.$Me_2NH$.TMEDA}$_2$ (IV)

[$Sb(NMe_2)_3$] (5.1 ml, 1.74 mol dm$^{-3}$ in toluene, 8.8 mmol) was added dropwise to a chilled solution of $CyPH_2$ (1.17 ml, 8.8 mmol) in hexane (20 ml). The solution was allowed to warm to room temperature and stirred (10 mins). The orange solution produced was transferred by syringe into a chilled (ca. −20° C.) solution of [CyPHNa] (prepared in situ by the reaction of $PhCH_2Na$ (1.0 g, 8.8 mmol) with $CyPH_2$ (1.17 ml, 8.8 mmol) in hexane (10 ml)/THF (5 ml)). The reaction mixture was allowed to warm to ca. 0° C. Excess TMEDA (ca. 3.0 ml, 20 mmol) was added and the solution was filtered while cold. Crystallisation at −35° C. (24 hrs) gave red plates of IV. Yield 1.1 g (16% on the basis of Sb supplied). Further crystallisation from the filtrate gave a mixture of IV and V (as black cubic crystals). Decomp. 75° C. $^1H$ NMR (+25° C., 250 MHz, D, toluene), 1.0–2.0 (overlapping mult., 40H, {CyP}$_4$), 2.22 (d., 4H ($^2J^{31}{}_{P-^1H}$ ca. 6.4 Hz), C(α)–H of {CyP}$_4$), 2.10 (br. s., 16H, TMEDA), 2.46 (s., 6H, $Me_2NH$). Elemental analysis; calcd. C, 50.4; H, 8.8; N, 5.5; P, 16.3; found C, 49.0; H, 8.6; N, 5.2; P, 15.1.

Crystal data for IV: $C_{32}H_{67}N_3P_4Sb$, M=762.51, monoclinic, space group $P2_1/n$ α=11.168(3), β=22.420(4), γ=16.468(3)Å, β=92.71(2)°,U=4119(1)Å$^3$, Z=4, $\rho_{calc.}$= 1.230 Mgm$^{-3}$, γ=0.71073 Å, T=223(2)K, μ(Mo−Kα)=0.859 mm$^{-1}$, F(000)=1608. Data were collected on a Siemens P4 diffractometer using an oil-coated rapidly-cooled crystal of dimensions 0.35×0.30×0.20 mm by the θ/2ω method (1.82°≦θ≦25.01°). Of a total of 7257 collected reflections, 7257 were independent ($R_{int.}$=0.073). Empirical absorption corrections were applied after initial refinement with isotropic displacement parameters (max., min. transmission 0.982, 0.778). The structure was solved by direct methods and refined by full-matrix least-squares on $F^2$ to final values of R1(F>4σ(F))=0.079 and wR2=0.271 (all data) [$R1=\Sigma|F_o-F_c|/\Sigma F_o$ and $wR2=(\Sigma w(F_o^2-F_c^2)^2/\Sigma w(F_o^2)^2)^{0.5}$, $w=1/[\sigma^2(F_o^2)+(yP)^2+xP]$, $P=F_o^2+(2F_c^2 3)$] largest peak and hole in the final difference map 0.808 and −0.844 eÅ$^{-3}$.

6. Formation of [$Sb_7Na_3$.3TMEDA.3THF] (V)

Example 5 was repeated using the same method and volumes of solvent, but the quantities of reagents were doubled and the solution was briefly brought to reflux prior to storage at −35° C. (24 hrs) to obtain complex (V). Yield 3.5 g (96% on the basis of the Sb supplied). The complex is stable at 25° C.

Crystal data for V; $C_{30}H_{72}N_6Na_3O_3Sb_7$, M=1486.16, monoclinic, space group P2(1)/m, Z=2, a=10.207(3), b=22.101(6), c=11.719(3)Å, β=92.249(19)°, U=2641.7(11) Å$^3$, $\rho_{calc}$=1.868 Mgm$^{-3}$, μ(Mo−Kα)=3.581 mm$^{-1}$, T=223(2) K, F(000)=1416. Data were collected on a Siemens P4 diffractometer on an oil-coated crystal of dimensions 0.40× 0.40×0.30 mm (1.97≦θ≦21.00). Of a total of 3779 data collected, 2935 were independent ($R_{int}$=0.098). An empirical absorption correction was applied. The structure was solved by direct methods and refined by full-matrix least-squares on $F^2$ to final values of R1 [I>2σ(I)]=0.086, ωR2=0.230 (all data). Largest difference between peak and hole 1.444, −1.076 eÅ$^{-3}$.

7. Preparation of {cyclo-[($^t$BuP)$_3$As]Li.TMEDA.THF} (VI)

[($^t$BuPH$_2$ was prepared by an original method using the reaction of $^t$BuPCl$_2$ with LiAlH$_4$ (1:2 eqiv.) in 1,4-dioxane. Double-distillation (760 mmHg) gave ca. 30–40% yields of the phosphine (boiling range 65–70° C.).

Synthesis of (VI)

To a stirred, chilled suspension of [LiPH$^t$Bu]$_n$ (6.0 mmol of monomer) in toluene (20 ml) and TMEDA (1.0 ml) was added a solution of [As(NMe$_2$)$_3$] (2.0 mmol, 0.92 cm$^3$, 2.17 mol dm$^{-3}$ in toluene). The suspension was stirred and gradually allowed to warm to 0° C., at which stage an orange precipitate was observed. THF (20 ml) was added and the mixture stirred for 48 h after which an orange solution (with a fine precipitate) remained. This was filtered and the solvent removed to ca. 8 ml. The solid produced was redissolved by the addition of THF (ca. 1 ml) and storage at −18° C. (12 h) gave orange crystals of (VI) suitable for X-ray diffraction studies; yield 0.27 g (25% on the basis of As supplied to the reaction); mp. 115° C. to clean to clean orange oil; IR (Nujol), major bands at 1260(m), 1032(s) cm$^{-1}$; $^7$Li NMR (155.505 MHz, +25° C., D$_8$-THF, rel. PhLi/THF), δ=−2.71 (s.), $^{31}$P NMR (161.969 MHz, +25° C., D$_8$-THF; rel. to 80% H$_3$PO$_4$/D$_2$O), δ=7.87 (t.), −74.50 (d.) (ratio 1:2, $^1J_{31P-31P}$=179.4±0.8 Hz); Elemental analysis calc. P, 17.4; found P, 17.6.

Crystal data for VI; $C_{22}H_{51}AsLiN_2OP_3$, M=534.42, monoclinic, space group P2$_1$/n, a=12.238(7), b=15.574(12), c=16.27(1), β=105.23(5)°, V=2993(4) Å$^3$, Z=4, $D_{calc}$=1.186 Mgm$^{-3}$, T=180(2)K, p(Mo−Kα)=1.311mm$^{-1}$, F(000)=1144. Data on a crystal of dimensions 0.40×0.28×0.28 mm were collected on a Siemens-Stoe diffractometer using ω/θ scans (3.56≦θ≧222.50). Of a total of 7645 reflections, 3900 were independent ($R_{int}$=0.1036). The structure was solved using direct methods and refined by full matrix least squares on $F^2$ (SHELXL 93) to final R indices of R1=0.086 [F>4σ(F)] and wR2=0.200 [all data]. The C atoms of the THF ligand and one of the C atoms of each of the MeN groups of the TMEDA were disordered over two sites and were refined with half occupancy. H-atoms were fixed geometrically.

8. Manufacture of Photoelectric Device

Construction of Demonstration Cell

Figure 7:
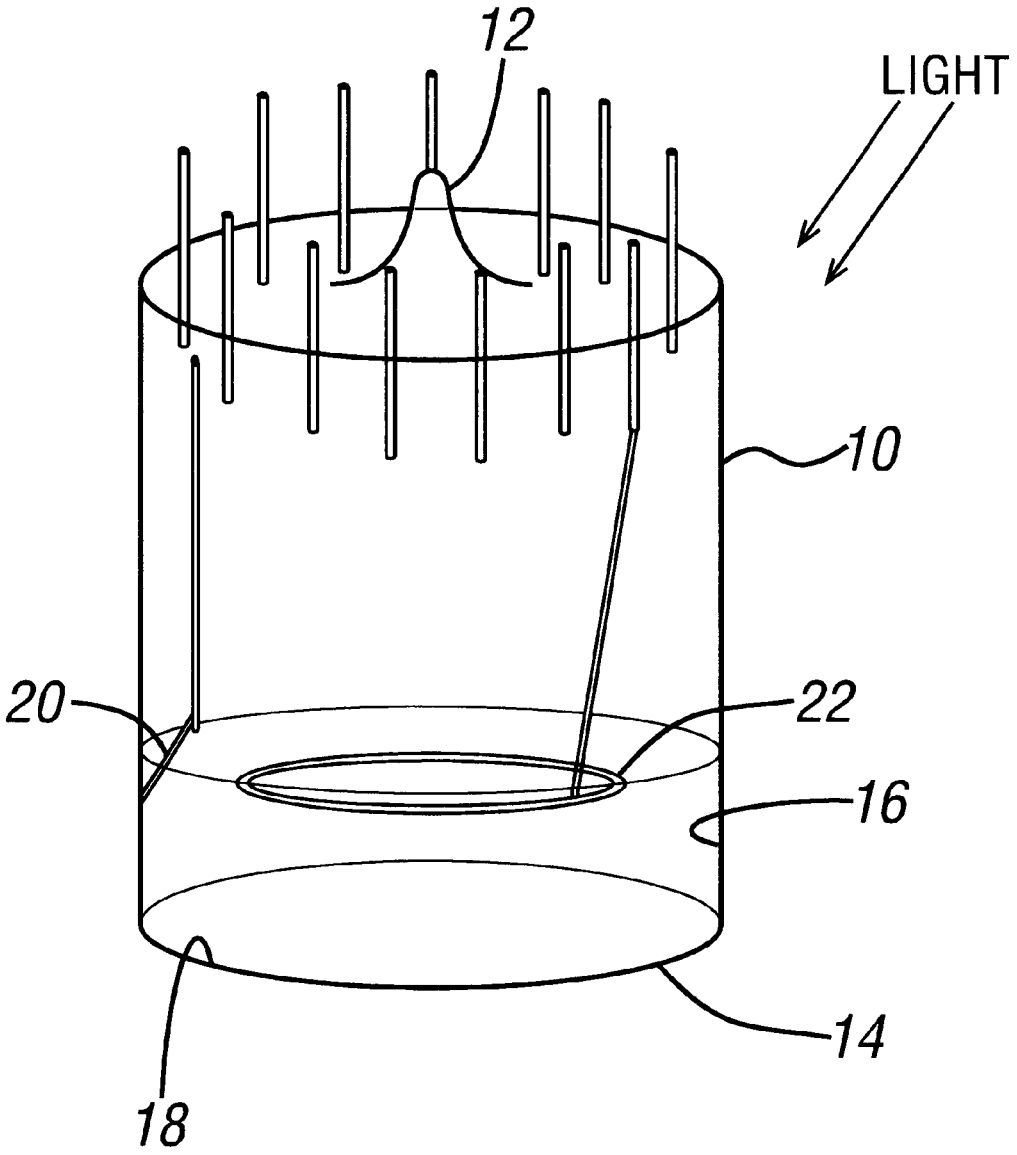
FIG. 7 Schematic representation of the LiSb photodiode test cell.

A photoelectric device in the form of a LiSb photodiode test cell, as depicted in FIG. 7, was constructed from a hollow glass cylinder 10, which has a constriction to allow the application of a vacuum at one end (shown sealed after evacuation in FIG. 7) 12, and a flat glass deposition surface 14 at the other end. The inside surface of the glass cylinder was aluminised to form a thin film 16 in contact with the deposition surface 14. A LiSb intermetallic layer 18 was formed on the deposition surface 14 in accordance with any of the Methods A–C described below. The test cell was further equipped with a cathode contact 20 to the aluminised film 16 and a central anode ring 22.

Formation of Intermetallic Layer on Test Cell

The intermetallic layer was formed on the test cell in accordance with one of the following methods A–C:

Method A

A solution of II in THF (ca. 0.01 mol dm$^{-3}$) was carefully introduced onto the deposition surface through the constriction 12 (shown sealed in FIG. 7) using a syringe so as to produce a solution surface of about 2 mm thick. The solvent was evaporated under vacuum from the deposition surface under argon to produce a golden-brown metallic film 18 on the deposition surface 14.

Method B

A solution of I in THF (ca;. 0.01 mol dm$^{-3}$) was carefully introduced onto the deposition surface through the constriction 12 (shown sealed in FIG. 7) using a syringe so as to produce a solution surface of about 2 mm thick. The solution was allowed to stand at a temperature of 30–40° C. in an argon atmosphere on a vacuum line to produce the same lustrous intermetallic film 18 as formed in Method A.

Method C

A solution of II suitable for use in accordance with the procedure described in Method A was formed from a THF solution of the unsolvated complex [Sb(PCy)$_3$]Li$_6$} [I*] by the method described in Example 2A.

Measurement of Photosensitivity and Spectral Response of the Li/Sb Test Cell

After construction of the test cell and formation of the intermetallic layer as described above, the test cell was evacuated to 10$^{-6}$ torr and the constriction 12 was flame sealed.

The photoelectric spectral response of the intermetallic layer was measured between 270 and 450 nm. Table 1 shows the quantum efficiency (expressed as a percentage) of the LiSb intermetallic compound after correction for the variation in optical transmission of the glass cylinder.

TABLE 1

Photosensitivity results for Sb/Li

| Wavelength (nm) | Quantum Efficiency |
|---|---|
| 270 | 1.35887 |
| 280 | 0.67085 |
| 290 | 0.46643 |
| 300 | 0.35504 |
| 310 | 0.30607 |
| 320 | 0.24717 |
| 330 | 0.26335 |
| 340 | 0.25002 |
| 350 | 0.19304 |
| 360 | 0.18368 |
| 370 | 0.03239 |
| 380 | 0.01079 |
| 390 | 0 |
| 400 | 0 |
| 410 | 0 |
| 420 | 0 |
| 430 | 0 |
| 440 | 0 |
| 450 | 0 |

Figure 8:
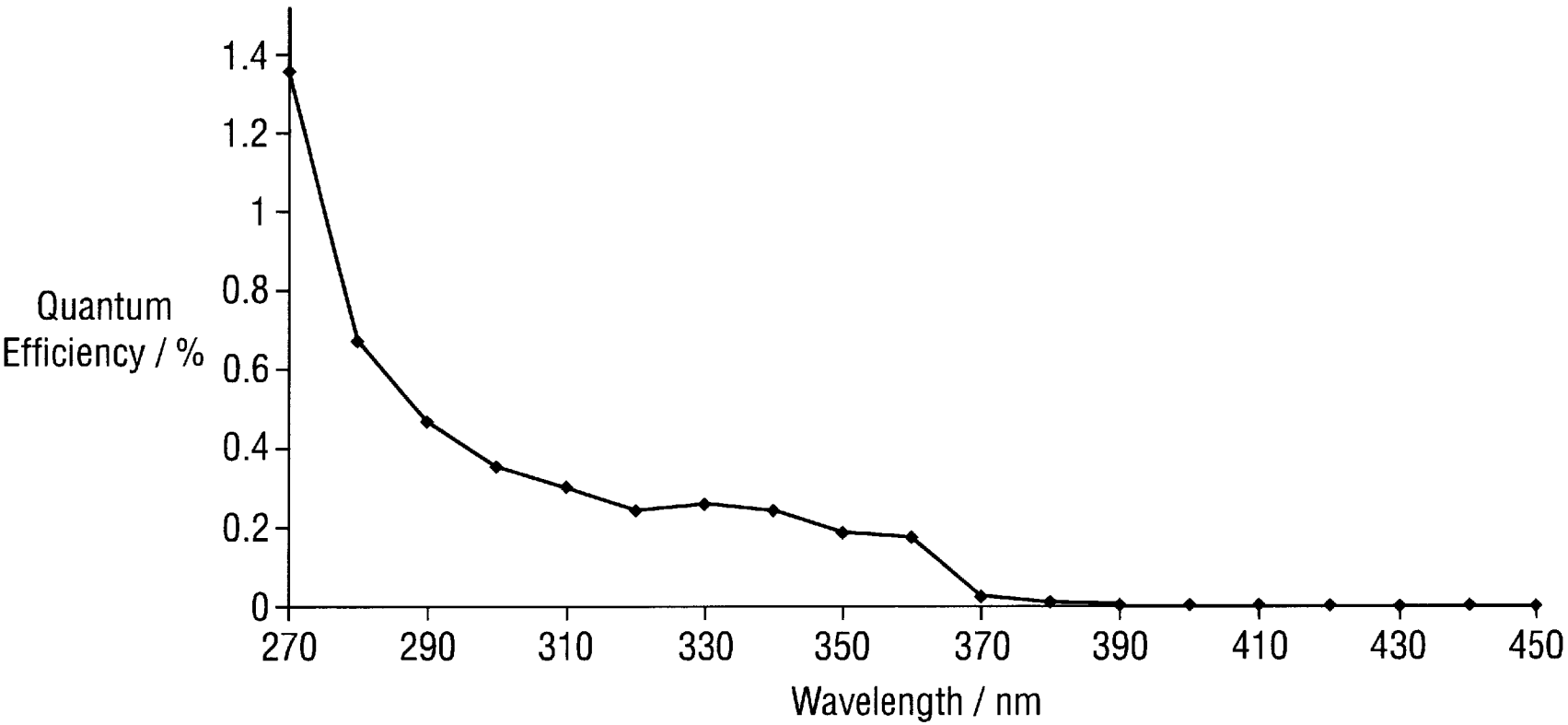
FIG. 8 Plot of the quantum efficiency values which are corrected for vacuum envelope transmission function, as a function of the wavelength.

The data from Table 1 are represented graphically in FIG. 8. FIG. 8 shows the corrected quantum efficiency of the LiSb test cell against wavelength after the transmission function of the vacuum envelope has been taken into account. The graph shows the onset of spectral response to be around 3.2 eV (for 390 nm), demonstrating the formation of a photosensitive LiSb intermetallic layer.

What is claimed is:

1. A process for the production of a Zintl compound, comprising subjecting a heterometallic phosphinidene complex to thermal decomposition, wherein the heterometallic phosphinidene complex comprises at least two metals.

2. The process according to claim 1, wherein one of said metals is a metal of Group 13, 14 or 15 of the Periodic Table.

3. The process according to claim 2, wherein one of said metals is a metal of Group 15 of the Periodic Table.

4. The process according to claim 2, wherein one of said metals is selected from the group consisting of As, Sb and Bi.

5. The process according to claim 1, wherein one of said metals is a metal of Group 1 of the Periodic Table.

6. The process according to claim 5, wherein one of said metals is Li, Na, K, Rb or Cs.

7. The process according to claim 1, wherein the heterometallic phosphinidene complex contains one or more phosphinidene ligands, which may be the same or different, and having a phosphorus atom covalently linked to a substituted or unsubstituted hydrocarbyl group.

8. The process according to claim 7, wherein the substituted or unsubstituted hydrocarbyl group contains 1 to 15 carbon atoms.

9. The process according to claim 8, wherein the substituted or unsubstituted hydrocarbyl group contains 4 to 10 carbon atoms.

10. The process according to claim 8, wherein the substituted or unsubstituted hydrocarbyl group is alkyl, alkenyl, alkynyl, cycloalkyl, aryl, aralkyl or alkaryl.

11. The process according to claim 10, wherein said hydrocarbyl group is substituted by one or more substituents independently selected from the group consisting of fluoro and alkylsilyl.

12. The process according to claim 7, wherein the heterometallic phosphinidene complex contains one or more phosphinidene ligands, having a phosphorus atom covalently linked to a cyclohexyl group.

13. The process according to claim 7, wherein the phosphorus atom of each of the phosphinidene ligands is coordinated to four metal atoms.

14. The process according to claim 13, wherein the phosphorus atom of each of the phosphinidene ligand is coordinated to three Group 1 metal atoms.

15. The process according to claim 13 or claim 14, wherein the phosphorus atom of the phosphinidene ligand is coordinated to one metal atom of Group 13, 14 or 15 of the Periodic Table.

16. The process according to claim 1, wherein the heterometallic phosphinidene complex comprises a ligand which is a Lewis base.

17. The process according to claim 16, wherein the Lewis base comprises one or more primary, secondary or tertiary amine groups or an ether group.

18. The process according to claim 17, wherein the Lewis base is a primary, secondary or tertiary amine of the formula $R^1R^2R^3N$, wherein each of $R^1$, $R^2$ and $R^3$ independently is hydrogen, a $C_1$–$C_6$ alkyl group, a $C_6$–$C_{10}$ aryl group, a polyamine, a permethylated polyamide, pyridine, polypyridine, or tetrahydrofuran.

19. The process according to claim 18, wherein the Lewis base is selected from the group consisting of dimethylamine, $((CH_3)_2NCH_2)_2$ (TMEDA) and $((CH_3)_2NCH_2CH_2)_2NCH_3$ (PMDETA).

20. The process according to claim 1, wherein the thermal decomposition results in the co-production of a phosphorus compound having at least one P—P bond.

21. The process according to claim 20, wherein the co-produced phosphorus compound is a cyclic phosphinidene.

22. A process according to claim 1 wherein the heterometallic phosphinidene complex comprises:

(i) a plurality of phosphinidene ligands (PR), wherein each R is independently $C_1$–$C_6$ alkyl, branched alkyl, cycloalkyl or aryl;

(ii) at least one metal, wherein said metal is a Group 14 or Group 15 metal;

(iii) at least one Group 1 metal selected from the group consisting of Li, Na, K, Rb and Cs; and (iv) a plurality of labile, Lewis base stabilizing ligands, each of which may be the same or different;

and said thermal decomposition process results in the co-production of a cyclic phosphinidene compound $(PR)_n$, wherein n is 4–6.

23. A process according to claim 1, wherein the stable heterometallic phosphinidene complex comprises:

(i) a plurality of phosphinidene ligands (PR), wherein each R is independently selected from the group consisting of $C_1$–$C_6$ alkyl, branched alkyl, cycloalkyl and aryl;

(ii) at least one metal selected from the group consisting of Ge, Sn, Pb, As, Sb and Bi;

(iii) at least one metal selected from the group consisting of Li, Na, K, Rb and Cs; and (iv) a plurality of labile, Lewis base stabilizing ligands, each of which may be the same or different, and said thermal decomposition process results in the co-production of a cyclic phosphinidene compound $(PR)_n$, wherein n is 4–6.

24. The process according to claim 1, wherein the thermal decomposition is carried out at a temperature of greater than 20° C.

25. The process according to claim 24, wherein the thermal decomposition is carried out in the temperature range of 25–100° C.

26. The process according to claim 1, wherein the thermal decomposition is carried out with the phosphinidene compound in solution in an organic solvent.

27. The process according to claim 26, wherein the organic solvent is a hydrocarbon.

28. The process according to claim 27, wherein the hydrocarbon is an n-alkane or an aromatic hydrocarbon.

29. The process according to claim 28, wherein the hydrocarbon is toluene or THF.

30. The process according to claim 1, wherein the heterometallic phosphinidene complex is $(Sb(PCy)_3)_2Li_6.6Me_2NH$, $((cyclo\text{-}(CyP)_4Sb)Na.Me_2NH.TMEDA)_2$, or $((t\text{-}BuP)_3As.Li.TMEDA.THF)$.

31. The process according to claim 1, wherein the Zintl compound comprises a polymetallic anion consisting of atoms of one or more metals.

32. The process according to claim 31, wherein said polymetallic anion is coordinated with metal cations, and the metal cations are coordinated with Lewis base ligands (Lg).

33. The process according to claim 31, wherein the Zintl compound comprises a polymetallic anion consisting of atoms of a first metal ($M^1$).

34. The process of claim 33, wherein said polymetallic anions are coordinated with cations of a second metal ($M^2$), and the cations of said second metal are coordinated with Lewis base ligands (Lg).

35. The process according to claim 34, wherein the Zintl compound has the formula $(M^1)_{n'}.(M^2)_{m'}.(Lg)_{p'}$, wherein n', m' and p' are integers independently in the range 1 to 10.

36. The process according to claim 33, wherein $M^1$ is a metal of Group 13, 14 or 15 of the Periodic Table.

37. The process according to claim 36, wherein $M^1$ is a metal of Group 15 of the Periodic Table.

38. The process according to claim 37, wherein $M^1$ is selected from the group consisting of As, Sb and Bi.

39. The process according to claim 34, wherein $M^2$ is a metal of Group 1 of the Periodic Table.

40. The process according to claim 39, wherein $M^2$ is Li, Na, K or Rb.

41. The process according to claim 32 or claim 34, wherein Lg comprises one or more primary, secondary or tertiary amine groups or an ether group.

42. The process according to claim 41 wherein Lg comprises one or more primary, secondary or tertiary amine groups.

43. The process according to claim 42, wherein Lg comprises a primary, secondary or tertiary amine group of the formula $R^1R^2R^3N$, where each of $R^1$, $R^2$ and $R^3$ independently is hydrogen, a $C_1$–$C_6$ alkyl group, a $C_6$–$C_{10}$ aryl group, a polyamine, a permethylated polyamide, pyridine, polypyridine or tetrahydrofuran.

44. The process according to claim 43, wherein Lg is selected from the group consisting of dimethylamine, TMEDA and PMDETA.

45. The process according to claim 1, wherein the phosphinidene complex is contacted with a primary or secondary amine prior to being subjected to thermal decomposition.

46. The process according to claim 45, wherein the phosphinidene complex which is contacted with the primary or secondary amine is free of stabilizing Lewis base ligand.

47. The process according to claim 45, wherein the phosphinidene complex which is contacted with primary or secondary amine, contains a stabilizing Lewis base ligand which is aprotic.

48. The process according to claim 45, wherein the phosphinidene complex is contacted with dimethylamine.

49. A process for the production of an intermetallic compound comprising:

(a) forming a Zintl compound by the process of claim 1; wherein said Zintl compound comprises a polyatomic anion comprising atoms of a first metal ($M^1$) and a stabilizing ligand (Lg); and (b) subsequently removing the stabilizing ligand.

50. The process of claim 49, wherein at (a) the polyatomic anion is coordinated with cations of a second metal ($M^2$), and the cations of said second metal are coordinated with said stabilizing ligand.

51. The process of claim 49, wherein the stabilizing ligand is a Lewis base ligand.

52. The process of claim 49, wherein at (b) the stabilizing ligand is removed under reduced pressure.

53. A process for the production of an intermetallic compound, comprising:

(a) forming a Zintl compound by subjecting a heterometallic phosphinidene complex to thermal decomposition, said Zintl compound comprising a polyatomic anion comprising atoms of a first metal $M^1$ and a stabilizing ligand, and (b) subsequently removing the stabilizing ligand.

54. The process of claim 53, wherein at (a) said polyatomic anion is coordinated with cations of a second metal ($M^2$), and the cations of said second metal are coordinated with said stabilizing ligand.

55. A method for forming an intermetallic layer on a surface which method comprises:

(a) applying a Zintl compound to the surface, said Zintl compound comprising a polyatomic anion comprising atoms of a first metal ($M^1$), wherein said polyatomic anion is coordinated with cations of a second metal ($M^2$), and the cations of said second metal are coordinated with a stabilizing ligand (Lg); and (b) subsequently removing the stabilizing ligand.

56. A method for forming an intermetallic layer on a surface which method comprises:

(a) applying a heterometallic phosphinidene compound, comprising a stabilizing ligand, to the surface; and (b) subjecting the heterometallic phosphinidene compound to thermal decomposition with concomitant loss of the stabilizing ligand;

wherein the heterometallic phosphinidene compound comprises at least two metals.

57. A method for forming an intermetallic layer on a surface which method comprises:

(a) applying a heterometallic phosphinidene compound to the surface;

(b) subjecting the heterometallic phosphinidene compound to thermal decomposition to et Zintl compound, said Zintl compound comprising a polyatomic anion comprising atoms a first metal ($M^1$), and cations of a second metal ($M^2$) which are coordinated with a stabilizing ligand; and (c) subsequently removing the stabilizing ligand.

58. The method according to any one of claims 55–57, wherein said surface is a surface portion of an electronic device.

59. The method according to claim 58, wherein said electronic device is a photoelectric device.

60. The method according to any one of claims 55–57, wherein said intermetallic layer is an electron emitter.

* * * * *